US006759610B1

(12) United States Patent
Dove et al.

(10) Patent No.: US 6,759,610 B1
(45) Date of Patent: Jul. 6, 2004

(54) MULTI-LAYER ASSEMBLY OF STACKED LIMMS DEVICES WITH LIQUID METAL VIAS

(75) Inventors: Lewis R. Dove, Monument, CO (US); Marvin Glenn Wong, Woodland Park, CO (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/455,031

(22) Filed: Jun. 5, 2003

(51) Int. Cl.[7] ..... H01H 29/00
(52) U.S. Cl. ..... 200/182
(58) Field of Search ..... 200/182, 187–189, 200/209–219, 233–236; 310/328, 331, 348, 363; 335/4, 47, 78; 385/19

(56) References Cited

U.S. PATENT DOCUMENTS

| | | | | |
|---|---|---|---|---|
| 2,312,672 A | | 3/1943 | Pollard, Jr. | |
| 2,564,081 A | | 8/1951 | Schilling | |
| 3,430,020 A | | 2/1969 | Tomkewitsch et al. | |
| 3,529,268 A | | 9/1970 | Rauterberg | |
| 3,600,537 A | | 8/1971 | Twyford | |
| 3,639,165 A | | 2/1972 | Rairden, III | |
| 3,657,647 A | | 4/1972 | Beusman et al. | |
| 3,955,059 A | * | 5/1976 | Graf | 200/181 |
| 4,103,135 A | | 7/1978 | Gomez et al. | |
| 4,200,779 A | | 4/1980 | Zakurdaev et al. | |

(List continued on next page.)

FOREIGN PATENT DOCUMENTS

| | | |
|---|---|---|
| EP | 0593836 A1 | 4/1994 |
| FR | 2418539 | 9/1979 |
| FR | 2458138 | 12/1980 |
| FR | 2667396 | 4/1992 |

(List continued on next page.)

OTHER PUBLICATIONS

TDB–ACC–NO: NB8406827, "Integral Power Resistors For Aluminum Substrate", IBM Technical Disclosure Bulletin, Jun. 1984, US, vol. 27, Issue No. 1B, p. 827.
Bhedwar, Homi C., et al. "Ceramic Multilayer Package Fabrication", Electronic Materials Handbook, Nov. 1989, pp 460–469, vol. 1 Packaging, Section 4: Packages.
Kim, Joonwon, et al., "A Micromechanical Switch With Electrostatically Driven Liquid–Metal Droplet", Sensors And Actuators, A; Physical v 9798, Apr. 1, 2002, 4 pages.
Simon, Jonathan, et al., "A Liquid–Filled Microrelay With A Moving Mercury Microdrop", Journal of Microelectromechanical Systems, Sep. 1997, pp 208–216, vol. 6, No. 3.

*Primary Examiner*—Michael A. Friedhofer
(74) *Attorney, Agent, or Firm*—Edward L. Miller

(57) ABSTRACT

The number of LIMMS devices in an assembly is increased by stacking multiple layers of LIMMS devices on top of one another, and interconnecting those device layers at an array of solder pads using solder balls. Each device layer uses vias to bring the needed conductors to the array of solder pads. All signals for the entire multi-layer assembly can be routed through the bottom LIMMS device layer to pass, through another array of solder pads onto a "mother substrate" of ceramic or other material that carries the multi-layer assembly. Alternatively, signals may enter or leave the upper LIMMS device layer by way of a flexible printed circuit harness. Vias may pass, either directly or by "dog legs" on interior surfaces, completely through the bottom LIMMS device layer, and through other device layers as needed. Opposing vias formed in the pair of substrates in a device layer have interior non-contacting pads that are bridged by a small ball of liquid metal held in place by a hole in a dielectric layer. Using patterned layers of dielectric to form bridging holes, cavities, channels and interconnecting passages for the LIMMS devices of both layers facilitates these needed vias and traces. Suitable thick film dielectric materials that may be deposited as a paste and subsequently cured include the KQ 150 and KQ 115 thick film dielectrics from Heraeus and the 4141A/D thick film compositions from DuPont.

13 Claims, 8 Drawing Sheets

U.S. PATENT DOCUMENTS 4,238,748 A 12/1980 Goullin et al.
4,245,886 A 1/1981 Kolodzey et al.
4,336,570 A 6/1982 Brower
4,419,650 A 12/1983 John
4,434,337 A 2/1984 Becker
4,475,033 A 10/1984 Willemsen et al.
4,505,539 A 3/1985 Auracher et al.
4,582,391 A 4/1986 Legrand
4,628,161 A 12/1986 Thackrey
4,652,710 A 3/1987 Karnowsky et al.
4,657,339 A 4/1987 Fick
4,742,263 A 5/1988 Harnden, Jr. et al.
4,786,130 A 11/1988 Georgiou et al.
4,797,519 A 1/1989 Elenbaas
4,804,932 A 2/1989 Akanuma et al.
4,988,157 A 1/1991 Jackel et al.
5,278,012 A 1/1994 Yamanaka et al.
5,415,026 A 5/1995 Ford
5,502,781 A 3/1996 Li et al.
5,644,676 A 7/1997 Blomberg et al.
5,675,310 A 10/1997 Wojnarowski et al.
5,677,823 A 10/1997 Smith
5,751,074 A 5/1998 Prior et al.
5,751,552 A 5/1998 Scanlan et al.
5,828,799 A 10/1998 Donald
5,841,686 A 11/1998 Chu et al.
5,849,623 A 12/1998 Wojnarowski et al.
5,874,770 A 2/1999 Saia et al.
5,875,531 A 3/1999 Nellissen et al.
5,886,407 A 3/1999 Polese et al.
5,889,325 A 3/1999 Uchida et al.
5,912,606 A 6/1999 Nathanson et al.
5,915,050 A 6/1999 Russell et al.
5,972,737 A 10/1999 Polese et al.
5,994,750 A 11/1999 Yagi
6,021,048 A 2/2000 Smith
6,180,873 B1 1/2001 Bitko
6,201,682 B1 3/2001 Mooij et al.
6,207,234 B1 3/2001 Jiang
6,212,308 B1 4/2001 Donald
6,225,133 B1 5/2001 Yamamichi et al.
6,278,541 B1 8/2001 Baker
6,304,450 B1 10/2001 Dibene, II et al.
6,320,994 B1 11/2001 Donald et al.
6,323,447 B1 11/2001 Kondoh et al.
6,351,579 B1 2/2002 Early et al.
6,356,679 B1 3/2002 Kapany
6,373,356 B1 4/2002 Gutierrez et al.
6,396,012 B1 5/2002 Bloomfield
6,396,371 B2 5/2002 Streeter et al.
6,408,112 B1 6/2002 Bartels
6,446,317 B1 9/2002 Figueroa et al.
6,453,086 B1 9/2002 Tarazona
6,470,106 B2 10/2002 McClelland et al.
6,487,333 B2 11/2002 Fouquet
6,501,354 B1 12/2002 Gutierrez et al.
6,512,322 B1 1/2003 Fong et al.
6,515,404 B1 2/2003 Wong
6,516,504 B2 2/2003 Schaper
6,559,420 B1 5/2003 Zarev
6,633,213 B1 10/2003 Dove
6,646,527 B1 * 11/2003 Dove et al. ..... 335/47
6,647,165 B2 * 11/2003 Hu et al. ..... 385/16
2002/0037128 A1 3/2002 Burger et al.
2002/0146197 A1 10/2002 Yong
2002/0150323 A1 10/2002 Nishida et al.
2002/0168133 A1 11/2002 Saito
2003/0035611 A1 2/2003 Shi

FOREIGN PATENT DOCUMENTS

JP 36-18575 10/1961
JP SHO47-21645 10/1972
JP 62-276838 12/1987
JP 63-294317 12/1988
JP 8-125487 5/1996
JP 9-161640 6/1997
WO WO99-46624 9/1999

* cited by examiner

MULTI-LAYER ASSEMBLY OF STACKED LIMMS DEVICES WITH LIQUID METAL VIAS

REFERENCE TO RELATED APPLICATIONS

The subject matter of this Application is related to that of U.S. patent application Ser. No. 10/423,316 filed 25 Apr. 2003 and entitled LIQUID METAL MICRO SWITCHES USING PATTERNED THICK FILM DIELECTRIC AS CHANNELS AND A THIN CERAMIC OR GLASS COVER PLATE, and is likewise also related to that of U.S. patent application Ser. No. 10/426,449 filed 30 Apr. 2003 and entitled LIQUID METAL MICRO SWITCHES USING AS CHANNELS AND HEATER CAVITIES MATCHING PATTERNED THICK FILM DIELECTRIC LAYERS ON OPPOSING THIN CERAMIC PLATES. These two Applications are hereby expressly incorporated by reference herein.

BACKGROUND OF THE INVENTION

Recent developments have occurred in the field of very small switches having moving liquid metal-to-metal contacts and that are operated by an electrical impulse. That is, they are actually small latching relays that individually are SPST or SPDT, but which can be combined to form other switching topologies, such as DPDT. (Henceforth we shall, as is becoming customary, refer to such a switch as a Liquid Metal Micro Switch, or LIMMS.) With reference to FIGS. 1-4, we shall briefly sketch the general idea behind one class of these devices. Having done that, we shall advance to the topic that is most of interest to us, which is an improved technique for fabricating a significant plurality of such switches on a collection of substrates.

Refer now to FIG. 1A, which is a top sectional view of certain elements to be arranged within a cover block 1 of suitable material, such as glass. The cover block 1 has within it a closed-ended channel 7 in which there are two small movable distended droplets (12, 13) of a conductive liquid metal, such as mercury. The channel 7 is relatively small, and appears to the droplets of mercury to be a capillary, so that surface tension plays a large part in determining the behavior of the mercury. One of the droplets is long, and shorts across two adjacent electrical contacts extending into the channel, while the other droplet is short, touching only one electrical contact. There are also two cavities 5 and 6, within which are respective heaters 3 and 4, each of which is surrounded by a respective captive atmosphere (10, 11) of a suitable gas, such as $N_2$. Cavity 5 is coupled to the channel 7 by a small passage 8, opening into the channel 7 at a location about one third or one fourth the length of the channel from its end. A similar passage 9 likewise connects cavity 6 to the opposite end of the channel. The idea is that a temperature rise from one of the heaters causes the gas surrounding that heater to expand, which splits and moves a portion of the long mercury droplet, forcing the detached portion to join the short droplet. This forms a complementary physical configuration (or mirror image), with the large droplet now at the other end of the channel. This, in turn, toggles which two of the three electrical contacts are shorted together. After the change the heater is allowed to cool, but surface tension keeps the mercury droplets in their new places until the other heater heats up and drives a portion of the new long droplet back the other way. Since all this is quite small, it can all happen rather quickly; say, on the order of a millisecond, or less. The small size also lends itself for use amongst controlled impedance transmission line structures that are part of circuit assemblies that operate well into the microwave region.

To continue, then, refer now to FIG. 1B, which is a sectional side view of FIG. 1A, taken through the middle of the heaters 3 and 4. New elements in this view are the bottom substrate 2, which may be of a suitable ceramic material, such as that commonly used in the manufacturing of hybrid circuits having thin film, thick film or silicon die components. A layer 14 of sealing adhesive bonds the cover block 1 to the substrate 2, which also makes the cavities 5 and 6, passages 8 and 9, and the channel 7, each moderately gas tight (and also mercury proof, as well!). Layer 14 may be of a material called CYTOP (a registered trademark of Asahi Glass Co., and available from Bellex International Corp., of Wilmington, Del.). Also newly visible are vias 15–18 which, besides being as tight, pass through the substrate 2 to afford electrical connections to the ends of the heaters 3 and 4. So, by applying a voltage between vias 15 and 16, heater 3 can be made to become very hot very quickly. That in turn, causes the region of gas 10 to expand through passage 8 and begin to force long mercury droplet 12 to separate, as is shown in FIG. 2. At this time, and also before heater 3 begins to heat, long mercury droplet 12 physically bridges and electrically connects contact vias 19 and 20, after the fashion shown in FIG. 1C. Contact via 21 is at this time in physical and electrical contact with the small mercury droplet 13, but because of the gap between droplets 12 and 13, is not electrically connected to via 20.

Refer now to FIG. 3A, and observe that the separation into two parts of what used to be long mercury droplet 12 has been accomplished by the heated gas 10, and that the right-hand portion (and major part of) the separated mercury has joined what used to be smaller droplet 13. Now droplet 13 is the larger droplet, and droplet 12 is the smaller. Referring to FIG. 3B, note that it is now contact vias 20 and 21 that are physically bridged by the mercury, and thus electrically connected to each other, while contact via 19 is now electrically isolated.

The LIMMS technique described above has a number of interesting characteristics, some of which we shall mention in passing. They make good latching relays, since surface tension holds the mercury droplets in place. They operate in all attitudes, and are reasonably resistant to shock. Their power consumption is modest, and they are small (less than a tenth of an inch on a side and perhaps only twenty or thirty thousandths of an inch high). They have decent isolation, are reasonably fast with minimal contact bounce. There are versions where a piezo-electrical element accomplishes the volume change, rather than a heated and expanding gas. There also exist certain refinements that are sometimes thought useful, such as bulges or constrictions in the channel or the passages. Those interested in such refinements are referred to the Patent literature, as there is ongoing work in those areas. See, for example, U.S. Pat. No. 6,323,447 B1.

To sum up our brief survey of the starting point in LIMMS technology that is presently of interest to us, refer now first to FIG. 4 and then to FIG. 5. In FIG. 4 there is shown an exploded view 25 of a slightly different arrangement of the parts, although the operation is just as described in connection with FIGS. 1–3. In particular, note that in this arrangement (25) the heaters (3, 4) and their cavities (5, 6) are each on opposite sides of the channel 7. Another new element to note in FIG. 4 is the presence of contact electrodes 22, 23 and 24. These are (preferably thin film) depositions of metal that are electrically connected to the vias (19, 20 and 21, respectively). They not only serve to ensure good ohmic contact with the droplets of liquid metal, but they are also regions for the liquid metal to wet against, which provides some hysteresis in the pressures required to move the droplets. This helps ensure that the contraction caused by the cooling (and contraction) of the heated (and expanded) operating medium does not suck the droplet back toward where it just came from. The droplets of liquid metal are not shown in the figure.

If contact electrodes 22–24 are to be produced by a thin film process, then they will most likely need to be fabricated after any thick film layers of dielectric material are deposited on the substrate (as will occur in connection with some of the remaining figures). This order of operations is necessitated if the thick film materials to be deposited need high firing temperatures to become cured; those temperatures can easily be higher than what can be withstood by a layer of thin film metal.

Also, if the layer of thin film metal is to depart from the surface of the substrate and climb the sides of a channel, then it might be helpful if the transition were not too abrupt. This may be arranged by staggering the positions (as in a staircase) of the edges of successive printed layers of the dielectric material as they are deposited to achieve an aggregate layer of a desired thickness.

FIG. 5 is a simplified exploded view 26 of a LIMMS device whose heater cavities, liquid metal channel and their interconnecting passages are formed in facing patterned layers of dielectric material (28, 30) between two substrates (27, 31), instead of being recesses in a cover block. The figure shows a portion of the two substrates 27 and 31, which may be of ceramic or glass, and which serves as bases upon which to fabricate the LIMMS device. Various metal conductors (not shown), and which may be of gold (suitably protected as explained below), are deposited on the surfaces of those substrates prior to the application of the patterned dielectric material, or they may be what remains from a patterned removal of an entire metal sheet originally present on the surface of the substrate. The latter case cooperates nicely in instances where some of the conductors are to be co-planar transmission lines formed with the presence of a ground plane. Vias may also be used to connect contact pads within the LIMMS device (i.e., the electrical terminals of the switch) to traces on the other side of a substrate, and to allow traces to pass from one side of a substrate to the other side.

Mercury amalgamates with gold, however, and if enough mercury is present, will dissolve it. It is therefore desirable to protect any gold that will come into contact with the mercury by a protective covering of another metal, such as platinum, that mercury will wet to but that does not interact with mercury. (Owing to the possibility of mercury smears during assembly, a complete over-covering of all the gold may be more desirable than simply covering the exposed pads where the droplet or slug of mercury might be expected to touch the gold during normal operation.) We shall have more to say about the protective covering in due course.

Now note the patterned layers 28 and 30. They are applied over the various conductors and vias of their respective substrates (27, 31), and may be of KQ 150 or KQ 115 thick film dielectric material from Heraeus, or the 4141A/D thick film compositions from DuPont. These are materials that are applied as pastes and then cured under heat at prescribed temperatures for prescribed lengths of time. Depending upon the particular material, they may be applied as an undifferentiated sheet, cured and then patterned (say, by laser or chemical etching) or they may be patterned upon their initial application (via a screening process). In any event, the patterning produces the heater cavities 34/45 and 33/46, the liquid metal channel 50 and their interconnecting passages (36, 37). The figure shows these passages (36, 37) being formed in only one layer (28) of the two layers of dielectric material. This is sufficient, although there could, if desired, also be matching passages in the other layer (30) leading from cavity halves 45 and 46 into the liquid metal channel 50.

The conventional thick film processes used to print patterned layers of the dielectric material allow considerable control over the finished thickness of one or more cured layers of dielectric material (which might be, say, in the range of five to ten thousandths of an inch), and achieving sufficient uniformity of thickness is not a major difficulty. However, there are limits to how thin and how thick an uncured printed layer can be, and it may be necessary to apply (print) multiple layers to achieve a particular overall depth for each of layers 28 and 30. For the KQ material that is to be printed on using a fine mesh (screen) of stainless steel, an individual printed uncured layer is on the order of one to two thousandths of an inch in thickness. The KQ material shrinks in thickness by an amount of about thirty percent during the curing process. It is possible to print several uncured layers, one on top of the other, and then fire the whole works, or, the application sequence could be print-fire-print-fire . . . , or even print-print . . . print-fire-print-print . . . . During the firing for curing the steep side walls and relatively sharp edges it is possible for the uncured printed layers become sloped and rounded, respectively. The resulting trapezoidal cross-sectional shape of the liquid metal channel 50 may be a significant influence in determining a desired thickness for layer 30. In this connection, the view 26 shown in FIG. 5 is a considerable simplification, in that, for simplicity of the drawing, the heater cavities 45 and 46, liquid metal channel 50, and their interconnecting passages 36 and 37 are all depicted as having steep side walls and sharp edges. It makes the basic subject matter of the drawing much easier to appreciate. When using printed KQ, however, the actual situation is much close to what is shown in FIGS. 6–8. Note the sloping side walls of the various patterned layers of dielectric material. Steep sidewalls and sharp edges are not necessarily bad, and can be obtained with other fabrication techniques, although that may also have an effect on the method used to create metalized regions, such as 47–49 that are to ascend such steep side walls.

Once layer 28 has been formed and patterned, metallic regions 42–44 are deposited over their respective vias (19–21 of FIG. 4, and which are not shown). These metallic regions 42–44 correspond to metallic contacts 22–24 of FIG. 4, and serve to improve electrical contact with the liquid metal and to provide a surface that can be wetted by the liquid metal (for latching). In similar fashion, metallic regions 47–49 may be deposited in the channel 50 to provide additional wetting surface for keeping the mercury in place between switching operations. (Regions 47–49 are not expected nor required to be in electrical contact with their corresponding regions 42–44.)

Note the heater resistors 34 (shown in place) and 35 (shown exploded above its intended location). On the tops of opposing edges of their respective heater cavities (32 and 33) are pair of metallic strips (40/41 and 38/39) that cover and connect to heater drive vias (not shown, but correspond to the likes of 17 and 18 in FIG. 4). In this manner the heater resistors 34 and 35 are suspended above the substrate for greater thermal efficiency, faster heating time and reduced electrical power consumption.

If desired, strips of metal may be applied around patterned layers 28 and 30 at the perimeter of the LIMMS device. Such strips are part of an hermetic seal that is formed of solder. Glass frit may also be used as a sealant, in which case the metal strip around the perimeter is not required. The hermetic seal may also involve there being beveled edges along the perimeter that receive the metal or frit. Some examples will be given later in connection with FIGS. 8 and 9. In any event, on the top surface of the patterned layer 38 of dielectric material is applied a correspondingly patterned layer 29 of adhesive, such as CYTOP. The patterning of the adhesive layer 29 matches the various features of the dielectric layers 28 and 30 that are to mate with each other, and for clarity is shown exploded away from patterned dielectric layer 28.

To assemble the LIMMS shown in view 26 of FIG. 5, the top-half (31/30) is turned upside-down. The channel 50 receives its droplets of liquid metal (not shown) and, while in an atmosphere of a suitable gas, such as $N_2$, the upside-down bottom half (27/28) would be registered and affixed against the upside-down top half (31/30). Then the hermetic seal would be formed.

We are always interested in techniques that improve device capability, reduce device fabrication cost, reduce the costs associated with connecting the device to a surrounding circuit, or increase the number of devices in a package without increasing the size of the footprint of the package. Increasing the number of LIMMS devices within a given footprint. has, it will be noted, the potential of improving device capability by both offering greater functionality for the hybrid as a whole (more switches means more things can be done) and better performance arising from shorter signal paths. Performance and cost both benefit from the reduced use of hybrid-to-hybrid interconnections achieved by putting more stuff onto one hybrid. The use on the bottom substrate for a LIMMS device of a patterned layer of dielectric forming cavities, channels and interconnecting passages is an attractive starting point. But even then, complex arrangements of LIMMS devices can spread out with increasing footprints and can also present trace routing problems. What to do?

SUMMARY OF THE INVENTION

An attractive solution to the problem of increasing the number of LIMMS devices in an assembly while minimizing the increase in the footprint of the assembly is to stack multiple layers of LIMMS devices on top of one another, and interconnect those layers at an array of solder pads using solder balls. Each layer includes a pair of substrates between which are formed the actual LIMMS devices themselves. The layers use vias to bring the needed conductors to the array of solder pads. All signals for the entire multi-layer assembly can be routed through the bottom LIMMS device layer to pass, through another array of solder pads onto a "mother substrate" of ceramic or other material that carries the assembly. Alternatively, signals may enter or leave the upper LIMMS device by way of a flexible printed circuit harness.

This plan contemplates creating vias that pass, either directly or by "dog legs" on interior surfaces, completely through the bottom LIMMS device layer, and through any other LIMMS device layers, as needed. Such "through the device layer" (of two substrates) vias are formed of two opposing vias having pads that do not touch but that are bridged by a small ball of liquid metal held in place by a hole in the surrounding dielectric material. It also contemplates traces that run horizontally within the interior of a LIMMS device layer. Using patterned layers of dielectric to form holes for liquid metal balls that join opposing vias, cavities, channels and interconnecting passages for the LIMMS devices of both layers facilitates these needed vias and traces. The use of such patterned layers itself depends upon the use of a suitable dielectric material, which must be strong, adheres well to the substrate, is impervious to contaminants, is capable of being patterned, and if also desired, which can be metalized for soldering. It should also have well controlled and suitable properties as a dielectric. Given a choice, a lower dielectric constant (K) is preferable over a higher one. Suitable thick film dielectric materials that may be deposited as a paste and subsequently cured include the KQ 150 and KQ 115 thick film dielectrics from Heraeus and the 4141A/D thick film compositions from DuPont.

DESCRIPTION OF A PREFERRED EMBODIMENT

Figure 6A:
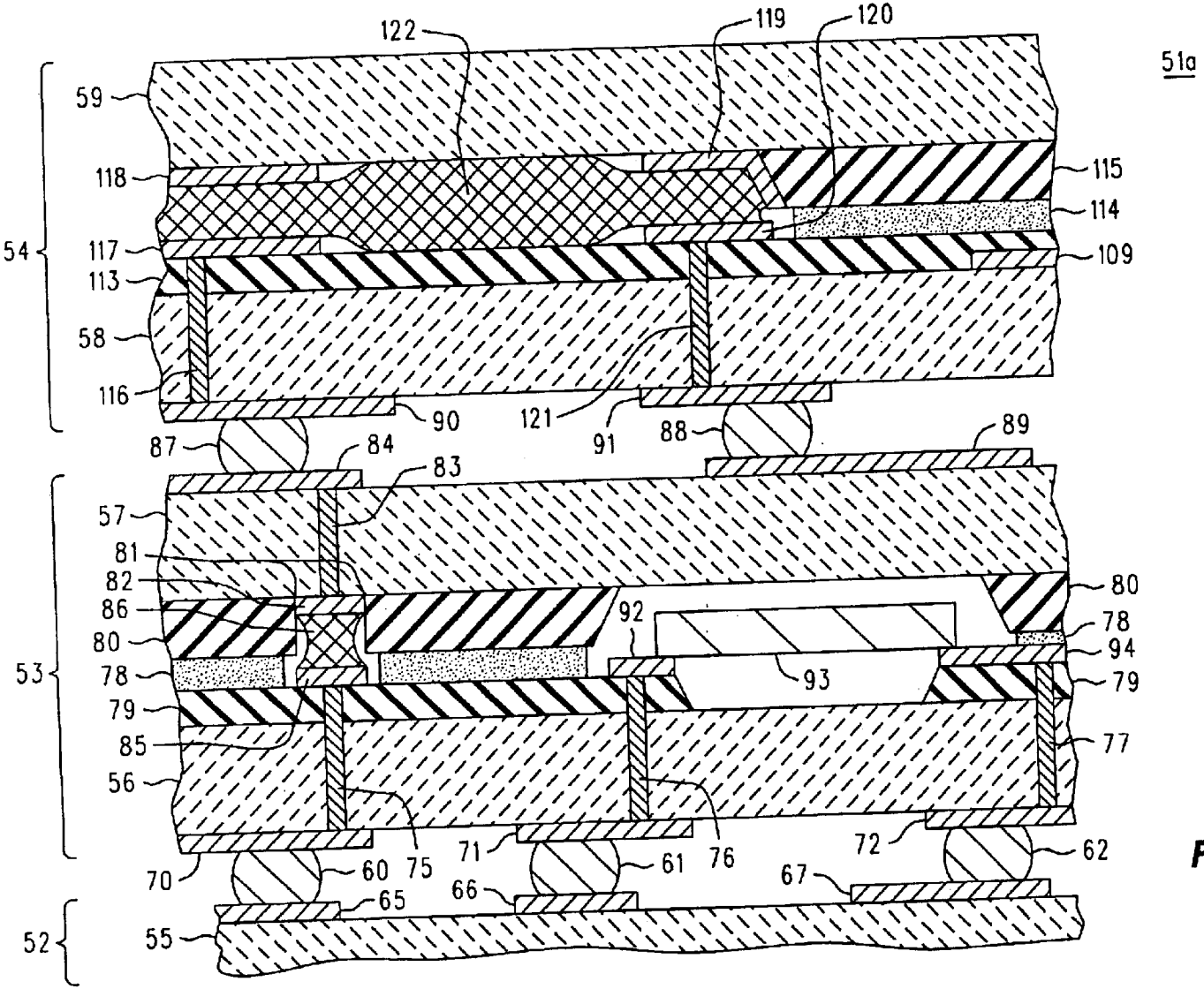
FIGS. 6A–B are a simplified partial cross sectional view of an exemplary multi-layer assembly of stacked LIMMS device constructed in accordance with principles of the invention.
Figure 6B:
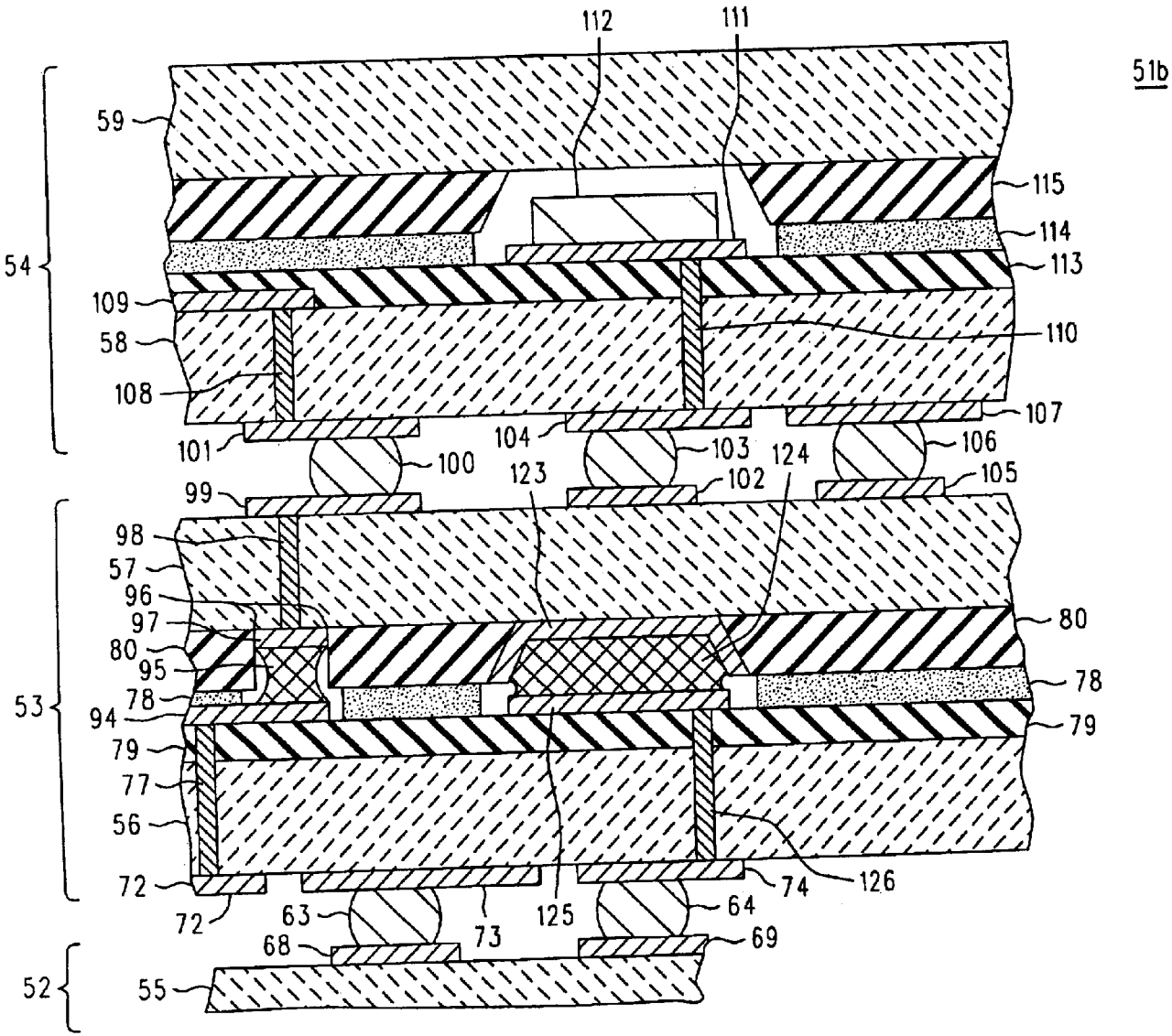

Refer now to FIGS. 6A and 6B, wherein is shown a simplified representation 51*a*/*b* of a partial cross section of a multi-layer assembly of stacked LIMMS devices. In particular, the LIMMS devices that are stacked are a lower LIMMS device 53 and an upper LIMMS device 54. The terms "lower" and "upper" are, of course, relative to the attitude of the entire assembly, and while convenient, should be understood as mere labels. Furthermore, it will readily be appreciated, as the explanation proceeds, that there could be a third (or fourth, etc.) layer of LIMMS devices atop the upper layer 54 or underneath the lower layer 53. That is, we are not limited to stacking just two layers of LIMMS devices. Also, the reader is urged to keep in mind that, although for brevity and economy in the drawings, we do not show expressly there being more than one LIMMS device within a layer, it is abundantly clear that a layer, whether lower, middle or upper, can have a large number of LIMMS devices fabricated within it.

By stacking layers of LIMMS devices we mean that the pairs of substrates that carry the innards that make up a LIMMS structure are registered one pair above (or below) another, that there are electrical connections (pads) that appear on the outer (top and bottom) surfaces of those substrate pairs, and that appropriate pads line up and are mechanically and electrically connected to create a unit assembly of many interconnected LIMMS devices. Surface mount techniques involving an array of solder ball and elastomeric connector gaskets using a suitable means of compression are examples of such mechanical and electrical connectivity. We prefer the use of surface mount solder balls, and that is what is shown in the drawings.

Such an assembly of stacked LIMMS devices most likely needs to be both mechanically and electrically connected to an environment that needs its switching functionality, and that is shown as element 52. It might be circuit board or another substrate. The same remarks about mechanical and electrical connection between the layers of paired substrates also apply to getting the whole assembly (53/54) mechanically and electrically connected to the outer environment 52. Once again, we prefer the solder ball technique, and have shown that method in the drawings.

With greater particularity now, note that the outer environment 52 includes a substrate or circuit board 55 upon which are located various traces and pads 65–69. In a known manner these are in spatial correspondence with a mirror image of pads and connecting traces 70–74 that are formed on the underside of the bottom substrate 56 of the lower LIMMS device 53. The desired mechanical and electrical connection between the outer environment 52 and the assembly of stacked LIMMS devices 53/54 is shown as accomplished with surface mount soldering techniques and solder balls 60–64.

The substrates 56 and 57 of the lower LIMMS device 53 and the substrates 58 and 59 of the. upper LIMMS device 54 have, as already mentioned, metallic pads and traces on their outer surfaces, and it is these that allow mechanical and electrical connections to be made. We have not shown any such metallic pads or traces on the outer surface of upper substrate 59, although it is clear that there could be some there if that were desired. Such metal may be of gold, and could either be printed on or what remains after etching away regions of a sheet to leave a pattern. Ground planes and the routing of ancillary traces may also be formed on these outer surfaces.

Let us turn now to the innards of the LIMMS devices 53 and 54. We shall begin with the bottom LIMMS device 53. After the manner shown in FIG. 5, elements 79 and 80 are patterned layers of dielectric material, such as KQ or the DuPont 4141A/D product. Element 78 is the intervening patterned layer of Cytop that acts both as a casket and a moderate hermetic seal, and also serves as an adhesive. And while we have shown pads and traces (70–74 and 54, 89, 99, 102 and 105) on the outer surfaces of the substrates 56 and 57, we have not shown any on the inner surfaces of those substrates. Although it is clear that there could be such traces if desired. (In the drawing the metal traces are shown thick enough to be readily visible, and as an appreciable percentage of the thickness of the patterned dielectric material. In reality, the traces are, compared to the layers of patterned dielectric 56 and 57, relatively thin, and the presence of such traces does not interfere with the function or shape of the patterned dielectric layers.)

Figure 1A:
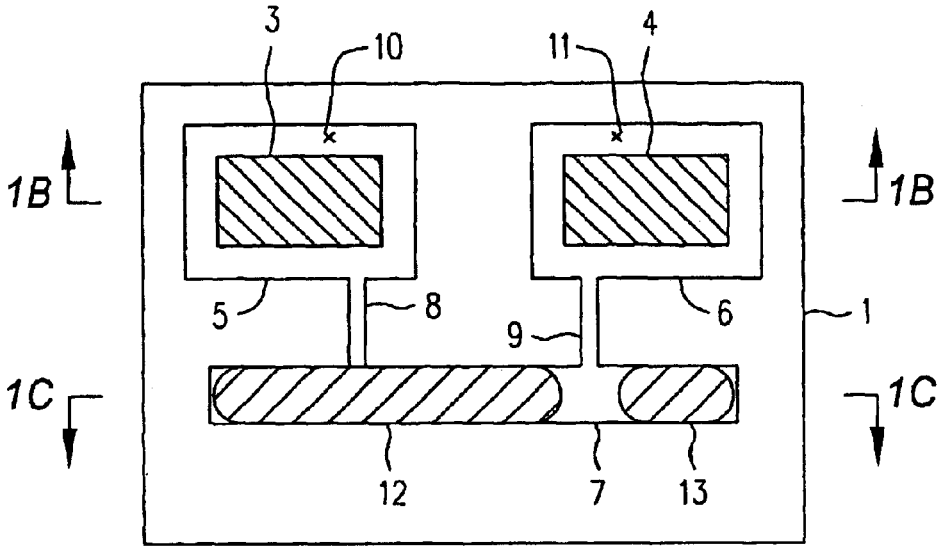
FIG. 1A PRIOR ART
FIGS. 1A–C are various sectional views of a prior art SPDT Liquid Metal Micro Switch (LIMMS) device, and wherein for convenience, while the heaters are shown as located on opposite ends of the channel, they are also shown as being on the same side thereof.
Figure 1B:
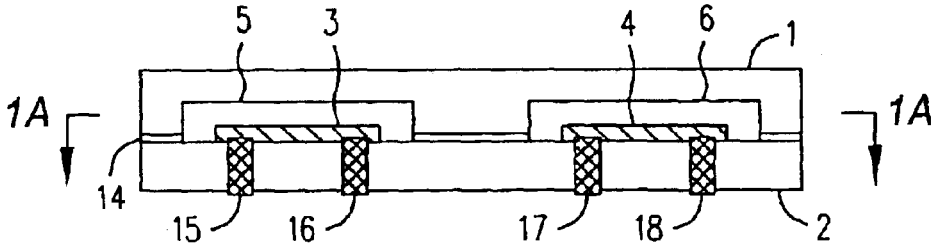
FIG. 1B PRIOR ART
Figure 1C:
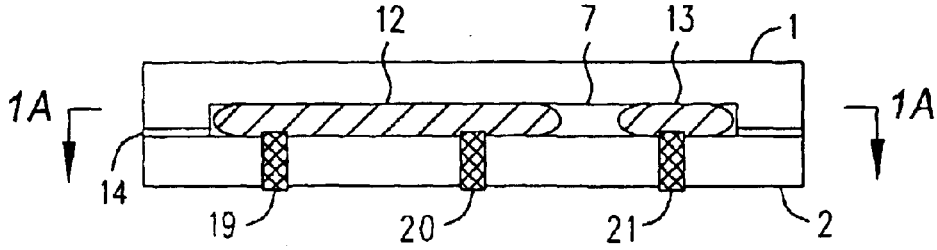
FIG. 1C PRIOR ART
Figure 2:
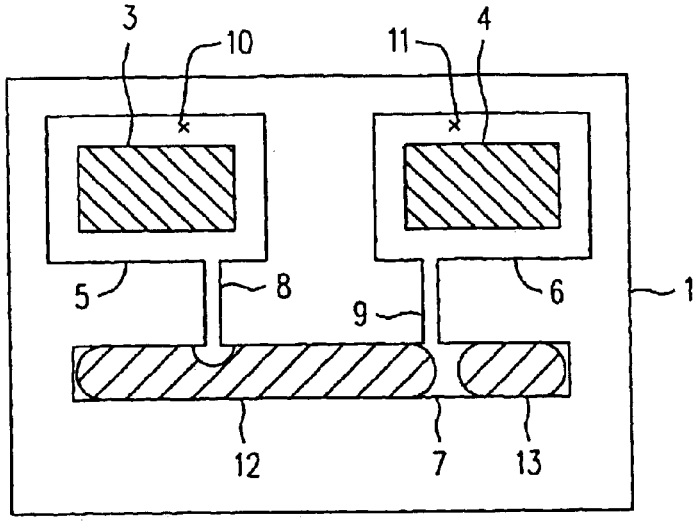
FIG. 2 PRIOR ART
FIG. 2 is a sectional view similar to that of FIG. 1A, at the start of an operational cycle.
Figure 3A:
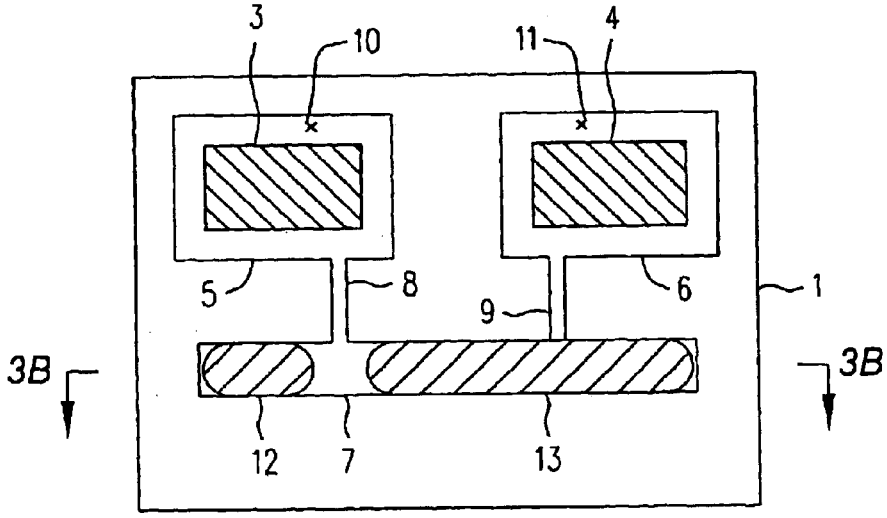
FIG. 3A PRIOR ART
FIGS. 3A–B are sectional views of the LIMMS device of FIGS. 1A–C at the conclusion of the operation begun in FIG. 2.
Figure 3B:
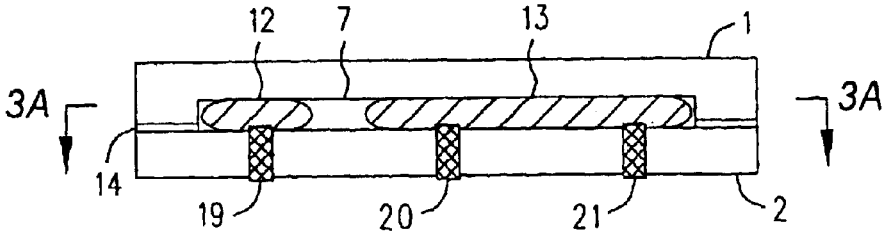
FIG. 3B PRIOR ART
Figure 4:
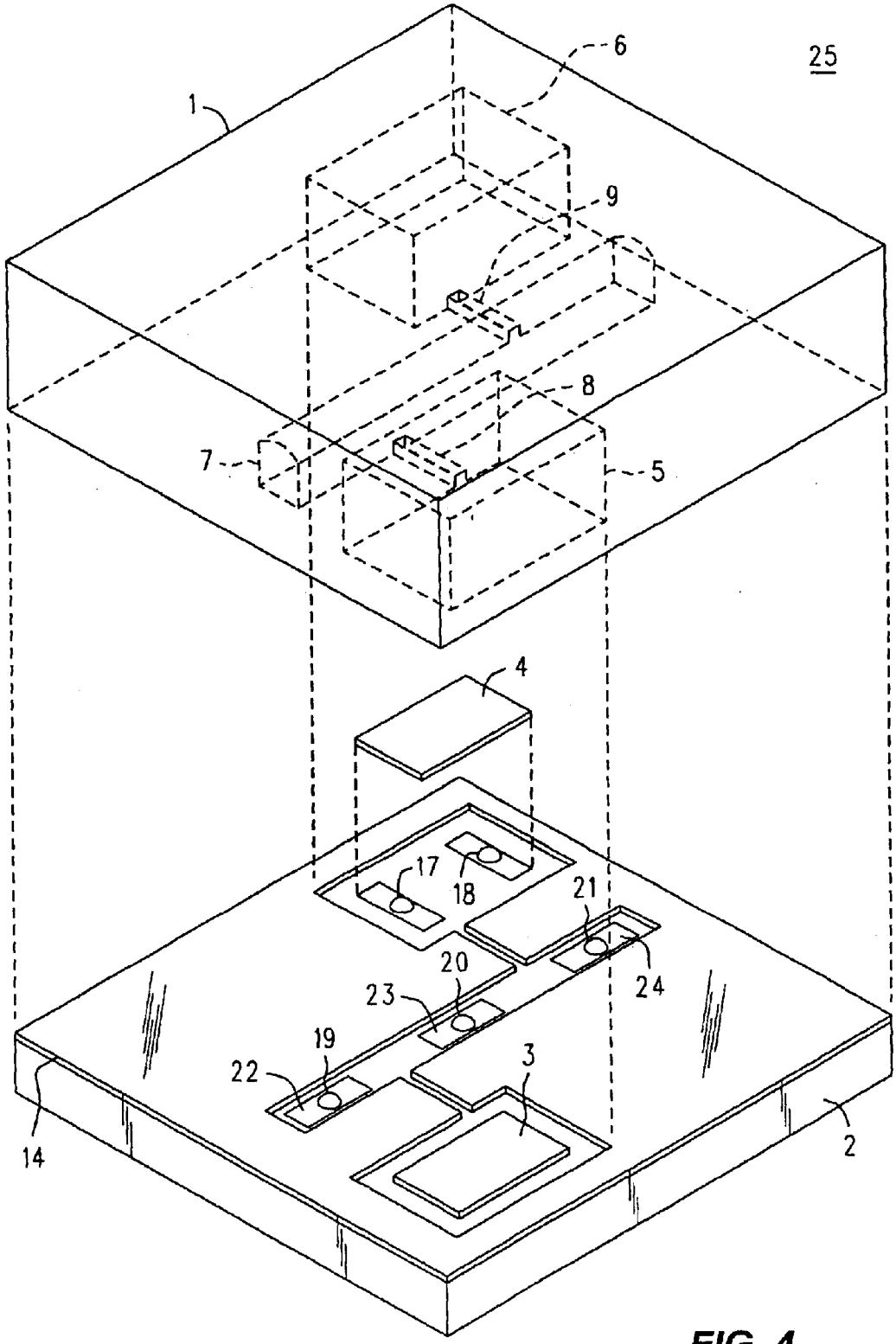
FIG. 4 PRIOR ART
FIG. 4 is an exploded view of a prior art SPDT LIMMS device similar to what is shown in FIGS. 1–3, but where the heaters are disposed both on opposite sides and on opposite ends of the channel.
Figure 5:
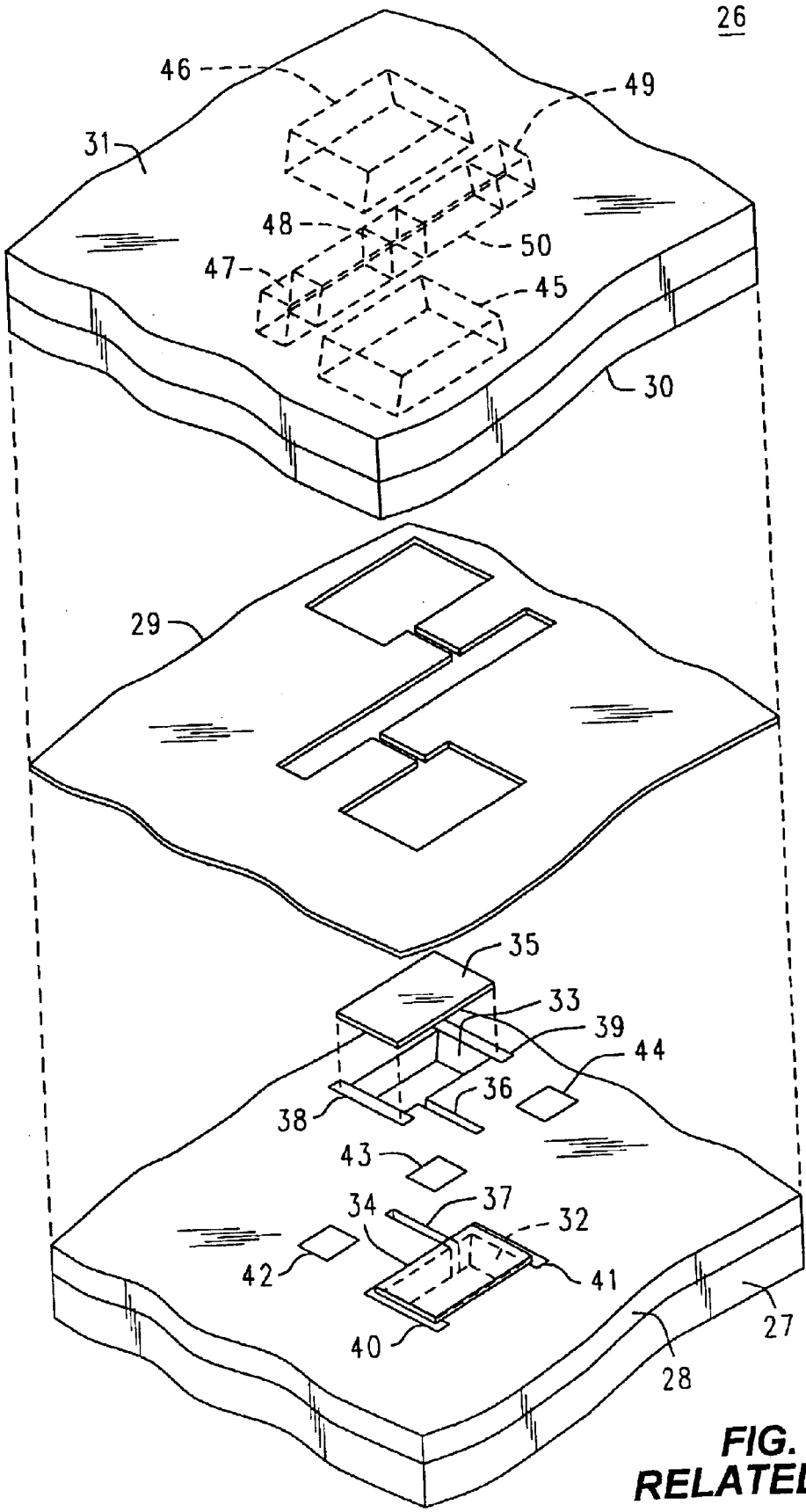
FIG. 5 RELATED ART
FIG. 5 is a simplified exploded view of a related art LIMMS device whose heater cavities, liquid metal channels and interconnecting passages are fabricated from patterned layers of thick film dielectric upon top and bottom substrates and attachable to a mother substrate by soldering to an array of pads on the underside of the device and connected by vias to elements inside the device.

Now consider the top LIMMS device layer 54. It is, as an isolated item, substantially similar to the related art described in connection with FIG. 5, and in the incorporated Applications. Thus, we find in layer 54 a lower substrate 58 and an upper substrate 59 that carry respective lower and upper patterned layers 113 and 115 of dielectric material, with an intervening patterned layer 114 of Cytop. Contact pads/traces 90, 91, 101 and 104 on the lower substrate 58 are respectively connected by vias 116,121, 108 and 110 to metallic contacts 117, 120, 109 and 111.The vias 116, 121, 108 and 110 pass through both the substrate 58 and the lower layer of patterned dielectric material 113, and are hermetically sealed by those pads/traces that these vias interconnect. The element 107 is a pad that turns into a trace that runs to some distant location (not visible in the cross section) before it encounters a via. Also shown is the longitudinal cross section of a slug 122 of liquid metal and the metallic wetting regions 118 and 119. Also shown in the figure is a (suspended) heater resistor 112, viewed along its length (i.e., it is at right angles to the slug 122). One might notice that the view shown here in FIG. 5 is not consistent with the parts layout of FIGS. 4 and 5: we see both one end of the resistor 112 and its via, while at the same time we see the center of the slug 122. Not to worry, though, as there are various possible ways that this might happen. First, there is no necessary assumption that slug 122 and heater resistor 112 are part of the same LIMMS device! There could be many LIMMS devices with the layer 54. Next, even if they were part of the same device, the placement of the parts within the layer is, within reason, quite flexible. So, the heater resistor 112 and its cavity might have been (relative to the plan of FIGS. 4 and 5) rotated 90° and then shifted a little along the length axis of the resistor, and a corresponding bend or dog leg put into the interconnecting gas passage (which passage is not shown).

Now consider the innards of lower LIMMS device layer 53. As with the upper layer 54, it includes an upper and lower substrate (57, 56) each bearing respective patterned dielectric layers (80,79) separated by a patterned layer 78 of Cytop This LIMMS device layer (53) depicts an along its-length cross section of a heater resistor 93 suspended between contact pads 92 and 94, as well as an across-its-length cross sectional view of liquid metal slug 124. The slug 124 is shown in (electrical) contact with contact pad 125 and in physical contact with metallic wetting region 123 (which is probably not electrically connected to anything besides the slug).

On the outer surface of the upper substrate 57 of the lower LIMMS device layer 53 are various trace/pad combinations (84, 89, 99, 102 and 105) that match the corresponding pad/traces (90, 91, 101, 104 and 107) on the outer surface of the lower substrate 58 of the upper LIMMS device layer 54. A corresponding pattern of respective solder balls 87, 88, 100, 103 and 106 perform the task of mechanically and electrically connecting the two LIMMS device layers (53, 54) together.

However, it will be noted that we have not yet provided a way to electrically connect a pad/trace (84, 89, 99, 102 and 105) on the outer surface of substrate 57 to any pad or trace fabricated on either side of the lower substrate 56. A via would go from the outer surface of substrate 57 to its inner surface, or further in to the surface on the patterned layer 80 of dielectric material that contacts the Cytop. But such a via and its pad, by themselves, will not make an electrical connection between the upper substrate 57 and the lower substrate 56. It seems pretty clear that we need such a technique if we are to have electrical signals on the mother substrate 55 routed up to LIMMS devices in the upper LIMMS device layer 54 by using pads (such as 65–69) that are within the footprint of the assembly as a whole.

Here is how that is done. Note that via 75 in the lower substrate 56 is registered beneath via 83 in the upper substrate. The contact pad 82 for via 83 is directly on the inner surface of substrate 57, but is exposed by a hole 81 in the patterned dielectric layer 80. Contact pad 85 for via 75 is aligned with the hole 81. Hole 81 is in the same half of the LIMMS layer 53 as is the channel for slug 124. At some point during assembly that half-layer (substrate 57 and its patterned dielectric layer 80) are upside down and the liquid metal (preferably mercury) is installed. A small ball of liquid metal 86 is placed into hole 81, at the same time as is any other liquid metal in the layer 53. Then the bottom half-layer (56, 79 and 80) is turned upside down and registered against the upside down top half-layer. In this way it is not necessary to rely on surface tension to hold the liquid metal in place as its half-layer is turned over as part of mating the two half-layers, and there is no risk of its falling out due to gravity.

Since contact pads 82 and 85 (and wettable regions 117–120) are to be in contact with mercury, their outer surfaces are first covered with a protective layer of metal that can be wetted with mercury but that is impervious to mercury if the metal forming those pads is one that amalgamates or reacts with mercury. Suitable protective metal coverings include platinum. Here is how pads such as 82, 85, and 117–120 can be formed. A base layer of Ti or Cr is first deposited. It provides conductivity with the plug of the via (in the case of a liquid metal via), and good adhesion to the ceramic substrate or the layer of patterned dielectric material. It is then covered with the protective layer of Pt, say to a thickness of around 5000 Å, which while clean is then in turn covered with a sacrificial layer of Au, say about 1000 Å thick. This business of the sacrificial layer of Au is to keep the surface of the Pt clean until after assembly. It appears that if exposed to the atmosphere, a layer of gases adheres to the surface of the Pt, preventing it from being wetted by the Hg after assembly. The sacrificial layer of gold is dissolved by the mercury within a few seconds after assembly, exposing the uncontaminated surface of the platinum, which it then readily wets to. The dissolved gold in the mercury does not interfere with operation.

The small liquid metal ball 86, which may be of mercury, electrically interconnects via 75 with via 83, allowing signals to pass completely through the LIMMS device layer 53 and to travel on to another layer by means of an array of pads and intervening solder balls (87, 88, 100, 103 and 106), as already explained.

Now, we have several additional things to point out in connection with this "through the layer by means of a liquid metal via" technique. First, note that we show another use of it for vias 77 and 98; not hole 96 and liquid metal ball 95. In this case, however, contact pad 94 is more that just a pad; it is also a trace that leads over to make electrical contact with heater resistor 93. (Note in passing that we have shown the layer of Cytop above trace 94 as thinner than elsewhere. This is true in principle, but not a concern in reality, since the Cytop is somewhat squishy and the trace 94 is sufficiently thinner than the Cytop.) The next thing to note is that via 77 is not directly beneath via 98. Just as trace 94 travels some distance along some path before it encounters the hole 96 and its liquid metal ball 95, both traces 94 and 97 could do that as desired, and in any direction and with whatever bends were useful. Finally, it will be appreciated that the "through the layer technique" just described could be used in the layer 54 to either make it an intervening layer for another LIMMS device layer atop it or to receive some other device, such as a flexible cable or another electronic assembly whose signals were to be connected to locations within the layers 53 and 54 or to the pads 65–69 on the mother substrate 55.

The various solder balls (60–64 and 87, 88, etc.) Are central to the surface mount ball grid technique: they re-flow against a matching pattern of contact pads upon the application of heat during the process of attaching (by soldering) the LIMMS device layers in FIGS. 6A/B to a larger part (52) that carries it. It will be appreciated that there may be a layer of solder resist (not shown) that assists in avoiding unwanted connection between a contact pad to be soldered and any conductive surface proximate thereto after mounting.

And now to a topic of some interest pertaining to the arrays of solder balls and their pads. While the traces and pads (e.g., 70, 84, 90) on the outer surfaces of LIMMS device layers 53 and 54 that receive solder balls might be either printed on or be the remnants of an undifferentiated sheet originally covering the entire bottom surface of the substrate (56, 57, 58) and patterned by etching, the subsequent manner of forming a plug/pad combination (e.g., 70/75, 91/121) is as follows. First, the associated hole is drilled and the hole filled (plugged) with a powdered composition including the metal, such as gold. It is then made hard and permanent by the application of beat, as in sintering. There is some shrinkage of the plug as it is fired, both longitudinally along its axis and in diameter. The diameter shrinkage creates a non-hermetic seal, which is also compounded by the porosity of the plug. After the plug is formed the bottom pad (70, 91) is printed using, for example, a powdered thick film composition of PtPdAg, which is then fired. The plug and the pad make electrical contact owing to their intimate proximity. The PtPdAg is, after curing, an effective hermetic seal across the (bottom) end of the via. The PtPdAg pad is thin, and if soldered to in the immediate region of the via plug, permits leaching of the via plug's metal through the pad and into the solder. This can embrittle the solder, which causes reliability problems. This leads us to use an enlarged or elongated pad with the solder ball offset from the plug.

Figure 7:
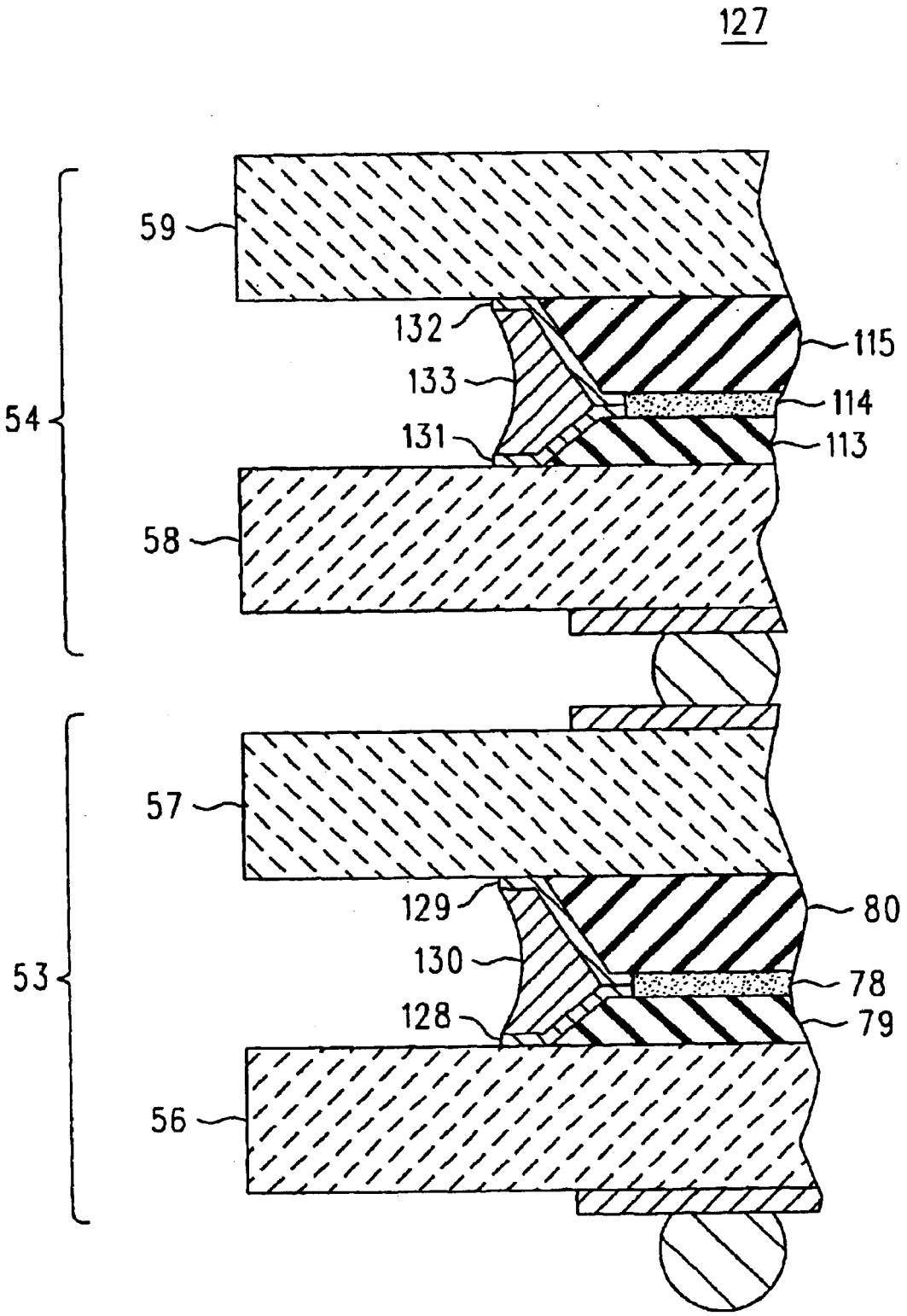
FIG. 7 is a simplified cross sectional view of a LIMMS device such as the one in FIG. 6, showing an exemplary method of creating an hermetic seal.

Now refer to FIG. 7. Here we show that an hermetic seal (130, 133) has been formed around the periphery of the LIMMS device layers 53 and 54. The seal may be of solder, or perhaps of glass frit. Solder may be preferable, since it flows a lower temperature. Solder needs a surface to wet to, so metallic layers 128 and 129 have been applied for solder seal 130, and metallic layers 131 and 132 for solder seal 133.

Figure 8:
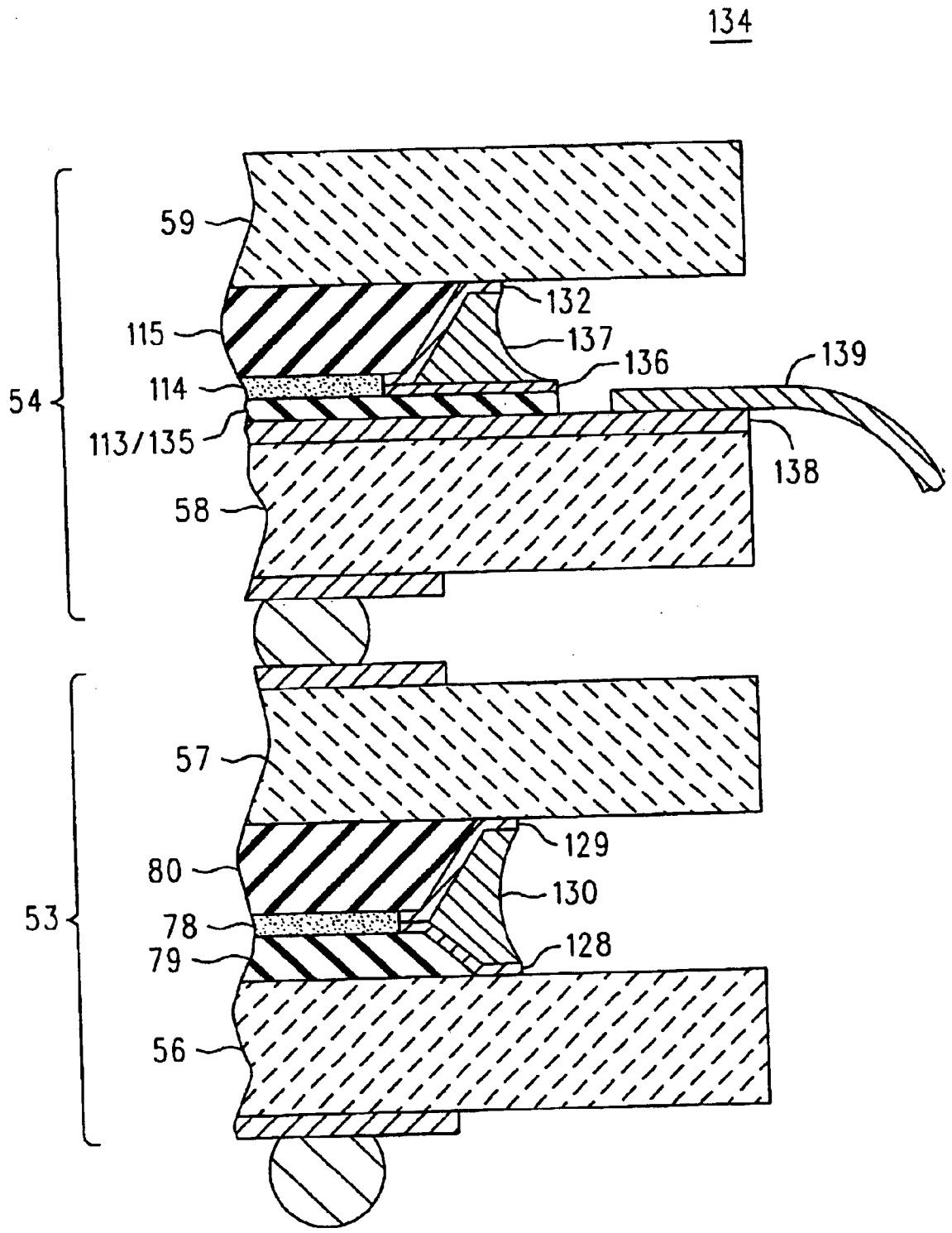
FIG. 8 is a simplified cross sectional view of a LIMMS device such as the one in FIG. 6 having an hermetic seal as shown in FIG. 7, but also having flexible printed conductors attached to an upper layer of LIMMS devices for making connections to an external electrical environment.

Finally, refer now to FIG. 8. It is quite similar to FIG. 7, except that for the upper layer 54 provision has been made for flexible printed circuit traces 139 (e.g., copper traces on Kapton) or other types of electrical interconnections (e.g., wire bond leads) to be attached to metallic traces 138 (only one can appear in the cross section, but it will be understood that there could be many). In cooperation with this situation, note how the dielectric layer 113/135 extends further out than before, and that the extended part carries a layer of metal 136. The seal itself 137 thus has a slightly different cross sectional shape.

We claim:

1. A multi-layer electrical switching assembly comprising:

a lower switching device layer;

an upper switching device layer;

each of the lower and upper switching device layers being respectively comprised of:

a first non-conductive substrate having first and second surfaces;

a first layer of dielectric material deposited upon the first surface of the first non-conductive substrate and patterned to create heater cavities, a liquid metal channel and passages connecting the heater cavities to locations along the liquid metal channel;

a second non-conductive substrate having first and second surfaces;

a second layer of dielectric material deposited upon the first surface of the second non-conductive substrate and patterned to match at least the heater cavities of the first layer of dielectric material;

a layer of adhesive deposited on the second layer of dielectric material and patterned to match the pattern of the first layer of dielectric material; and the first surfaces of the first and second non-conducting substrates facing each other and being brought into contact through the intervening first and second layers of dielectric material and the layer of adhesive;

the lower switching device layer having on the second surface of the first non-conductive substrate a lower pattern of conductive pads for mounting by solder balls the multi-layer electrical switching assembly at a destination location, on the first surface of the second non-conductive substrate an upper pattern of conductive pads, and a collection of vias that selectively interconnect the upper and lower patterns of pads with each other and also, by conductive traces formed on the first layer of dielectric material, with selected locations within the heater cavities and the liquid metal channel; and the upper switching device layer having on the second surface of the first non-conductive substrate a lower pattern of conductive pads electrically connecting by solder the multi-layer electrical switching assembly to the upper pattern of conductive pads on the second surface of the second non-conductive substrate of the lower switching device layer, and a collection of vias that selectively interconnect that lower patterns of pads, by conductive traces formed on the upper switching device layer's first layer of dielectric material, with selected locations within the heater cavities and the liquid metal channel.

2. An electrical switching assembly as in claim 1 wherein at least one of the non-conductive substrates is of glass.

3. An electrical switching assembly as in claim 1 wherein at least one of the non-conductive substrates is of ceramic.

4. An electrical switching assembly as in claim 1 further comprising conductive vias through the first non-conductive substrate and the first layer of dielectric material, an end of each of the conductive vias being within the heater cavity.

5. An electrical switching assembly as in claim 4 further comprising pads inside the heater cavity that cover the vias and a heater resistor suspended between the pads.

6. An electrical switching assembly as in claim 4 further comprising the conductive vias through the first non-conductive substrate and the first layer of dielectric material, an end of each of the conductive vias being within the liquid metal channel.

7. An electrical switching assembly as in claim 1 wherein the first and second layers of dielectric material for the upper and lower switching device layers are deposited with thick film techniques.

8. An electrical switching assembly as in claim 1 further comprising at least one flexible conductor soldered to a conductive trace that is part of one of the upper and lower switching device layers.

9. An electrical switching assembly as in claim 1 wherein the upper switching device layer further comprises an upper pattern of conductive pads on the second surface of the second non-conductive substrate and that are connected by vias in the upper switching device layer to locations within the upper switching device layer, and further wherein the multi-layer electrical switching assembly further comprises an additional switching device layer having a lower pattern of conductive pads connected to vias in the additional switching device layer and soldered to the upper pattern of conductive pads on the upper switching device layer.

10. A LIMMS assembly with a liquid metal via, the assembly comprising:

a first non-conductive substrate having first and second surfaces;

a first metallic contact pad on the first surface of the first substrate;

a first layer of dielectric material deposited upon the first surface of the first non-conductive substrate and patterned to create a via bridging hole exposing a portion of the first metallic contact pad, and also to create heater cavities, a liquid metal channel and passages connecting the heater cavities to locations along the liquid metal channel;

a second non-conductive substrate having first and second surfaces;

a second layer of dielectric material deposited upon the first surface of the second non-conductive substrate;

the via located in the second substrate and having a second metallic contact pad on the second layer of dielectric material;

a layer of adhesive deposited on the second layer of dielectric material and patterned to match the pattern of the first layer of dielectric material; and the first surfaces of the first and second non-conducting substrates facing each other and being brought into contact through the intervening first and second layers of dielectric material and the layer of adhesive; and a ball of liquid metal in the bridging hole and electrically connecting the first and second metallic contact pads.

11. A LIMMS assembly as in claim 10 wherein the liquid metal is mercury and the first and second metallic contact pads comprise an outer layer of Pt that was originally covered by a sacrificial layer of Au.

12. A multi-layer electrical assembly having a liquid metal via, the assembly comprising:

a first non-conductive substrate having first and second surfaces;

a first metallic contact pad on the first surface of the first substrate;

a first layer of dielectric material deposited upon the first surface of the first non-conductive conductive substrate and patterned to be absent in selected regions including at least a bridging hole exposing a portion of the first metallic contact pad;

a second non-conductive substrate having first and second surfaces;

the via located in the second substrate and having a second metallic contact pad on the first surface of the second non-conductive substrate;

a layer of adhesive deposited on the first surface of the second non-conductive substrate and patterned to match the pattern of the first layer of dielectric material; and the first surfaces of the first and second non-conducting substrates facing each other and being brought into contact through the intervening first layer of dielectric material and the layer of adhesive; and a ball of liquid metal in the bridging hole and electrically connecting the first and second metallic contact pads.

13. A multi-layer assembly as in claim 12 wherein the liquid metal is mercury and the first and second metallic contact pads comprise an outer layer of Pt that was originally covered by a sacrificial layer of Au.

* * * * *